US005317769A

United States Patent [19]

Weismiller et al.

[11] Patent Number: 5,317,769

[45] Date of Patent: Jun. 7, 1994

[54] HOSPITAL BED

[75] Inventors: Matthew W. Weismiller; David J. Pleiman, both of Batesville; Kenneth L. Kramer, St. Paul, all of Ind.

[73] Assignee: Hill-Rom Company, Inc., Batesville, Ind.

[21] Appl. No.: 974,256

[22] Filed: Nov. 10, 1992

[51] Int. Cl.[5] ..... A61G 7/00

[52] U.S. Cl. ..... 5/610; 5/611; 5/616; 74/89.15

[58] Field of Search ..... 5/610, 611, 616; 74/89.15

[56] References Cited

U.S. PATENT DOCUMENTS

| | | | |
|---|---|---|---|
| 1,037,419 | 9/1912 | Bosanko | 5/610 |
| 3,220,718 | 11/1965 | Wikkerink | 74/89.15 |
| 3,725,966 | 4/1973 | Blecker . | |
| 3,781,927 | 1/1974 | Zakaras . | |
| 3,797,052 | 3/1974 | Licina et al. . | |
| 3,858,452 | 1/1975 | Gatland et al. | 74/89.15 |
| 4,435,862 | 3/1984 | King et al. . | |
| 4,489,449 | 12/1984 | Failor et al. . | |
| 4,494,259 | 1/1985 | Miller et al. . | |
| 4,534,077 | 8/1985 | Martin | 5/424 |
| 4,552,403 | 11/1985 | Yindra | 74/89.15 X |
| 4,559,655 | 12/1985 | Peck | 5/616 |
| 4,638,516 | 1/1987 | Vrzalik | 5/616 X |
| 4,658,450 | 4/1987 | Thompson | 5/611 X |
| 4,691,393 | 9/1987 | Kuck . | |
| 4,858,260 | 8/1989 | Failor et al. . | |
| 5,063,624 | 11/1991 | Smith et al. . | |
| 5,084,922 | 2/1992 | Louit | 5/611 X |
| 5,129,116 | 7/1992 | Borders et al. | 74/89.15 X |
| 5,134,731 | 8/1992 | Quintile et al. | 5/611 X |
| 5,161,274 | 11/1992 | Hayes et al. | 5/616 X |

*Primary Examiner*—Michael F. Trettel
*Attorney, Agent, or Firm*—Wood, Herron & Evans

[57] ABSTRACT

A hospital bed has two mechanical drive mechanisms connected between each end of a bed support frame and a base, each of which has a respective actuator. Selective operation of each of the drive mechanisms with the actuators permits either end of the bed support frame to be inclined to the Trendelenburg and reverse Trendelenburg positions at any height of the hospital bed. The drive mechanisms transfer forces for raising and lowering the bed support frame but do not transfer force when the bed is lowered onto an obstacle. When an obstacle is encountered, a switch interrupts operation of its respective actuator.

12 Claims, 4 Drawing Sheets

HOSPITAL BED

BACKGROUND OF THE INVENTION

1. Field of the Invention

The present invention relates to a hospital bed and more particularly to dual drive mechanisms with respective actuators for selectively raising and lowering either end of a hospital bed.

2. Background of the Invention

Many activities and therapies require that a hospital bed be adjustable to different heights, and/or its ends be inclined relative to a horizontal plane so that either the foot of the bed is elevated above the head of the bed, i.e. the Trendelenburg position, or the head of the bed is elevated above the foot of the bed, i.e. the reverse Trendelenburg position. It is further desirable that the Trendelenburg or reverse Trendelenburg positions be achieved at any height of the bed.

U.S. Pat. No. 4,494,259 discloses one apparatus for controlling the height and inclination of either end of a hospital bed. In that disclosure an actuator drives one or two screw and nut drives which may be connected by a clutch. Engaging the clutch couples the screws causing both screws to rotate in unison. The bed is raised or lowered via a linkage mechanism connected between the bedframe and the nuts. Disengagement of the clutch decouples the screws, and one screw and nut drive is operative to raise or to lower a foot end of the bedframe. Consequently, the Trendelenburg position may be achieved by engaging the clutch, fully lowering the bed, disengaging the clutch and raising the foot end of the bed. The reverse Trendelenburg position is achieved by engaging the clutch, raising the bed, disengaging the clutch and lowering the foot end of the bed. Consequently, to move from the Trendelenburg position to the reverse Trendelenburg position or vice versa, it is often necessary to change the height of the bed before its inclination may be changed.

In view of the fact that hospital bed motion must be very slow to accommodate the sensitivities of a patient, this dual motion is inefficient and requires additional personnel time.

SUMMARY OF THE INVENTION

To overcome the disadvantages of existing mechanisms, a primary object of the invention is to provide a hospital bed in which the height of each end of the bed may be independently controlled regardless of the height of the bedframe.

According to the principles of the present invention, a hospital bed has a hospital bed support frame connected to a base by means of first and second mechanical drives connecting each end of the bed support to the base. The first and second mechanical drives are connected to first and second motors, respectively. The motors may be operated simultaneously to move both ends of the bed support together in the same direction thereby changing the height of the bed support frame relative to the base. Further, the motors may be selectively operated to move one end of the bed support vertically relative to the other end, thereby selectively moving the bed support to the Trendelenburg and reverse Trendelenburg positions. The mechanical drives are constructed to stop the operation of the motors upon either end of the bed support encountering an obstacle while being lowered.

One advantage of the present invention is that each end of the bed is under independent control at every height location. The independent control permits desired bed angles to be more efficiently and quickly attained.

Another advantage of the present invention is that upon the bed support engaging an obstacle or other interference while being lowered the operation of the mechanical drive is interrupted.

These and other objects and advantages of the present invention will become more readily apparent during the following detailed description taken in conjunction with the drawings herein.

DETAILED DESCRIPTION OF THE INVENTION

Figure 1:
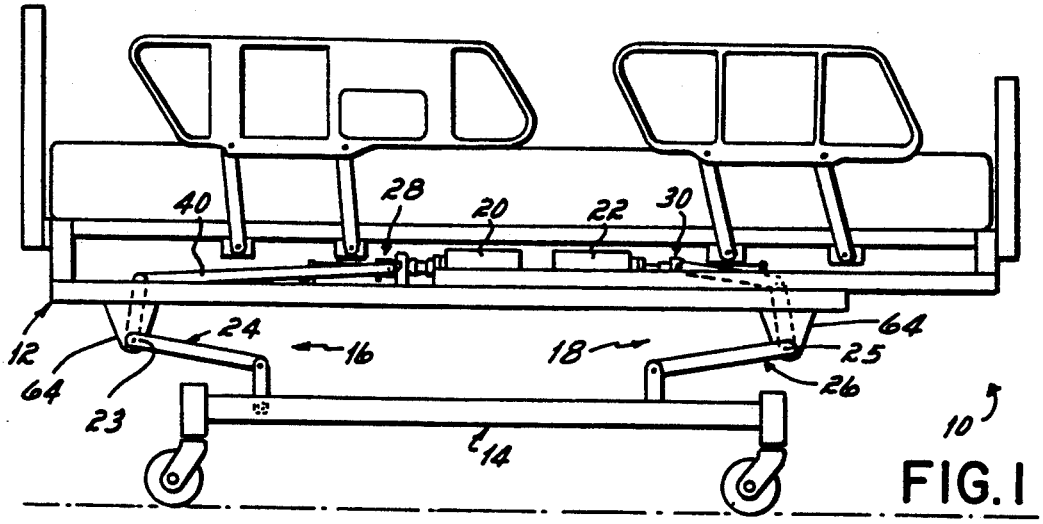
FIG. 1 is a side elevation view illustrating a hospital bed in a raised position.

FIGS. 1-5 illustrate a hospital bed employing the present invention. The bed 10 includes a bed support frame 12 connected to a base 14 by means of first and second mechanical drives 16 and 18 which are connected to actuators 20 and 22, respectively. The mechanical drives 16 and 18 are pivotally connected to the bed support frame 12 at pivot points 23 and 25. One end of each of the mechanical drives 16 and 18 is connected to the base 14 and the other end of each of the mechanical drives 16 and 18 is connected to actuators 20 and 22, respectively.

Figure 2:
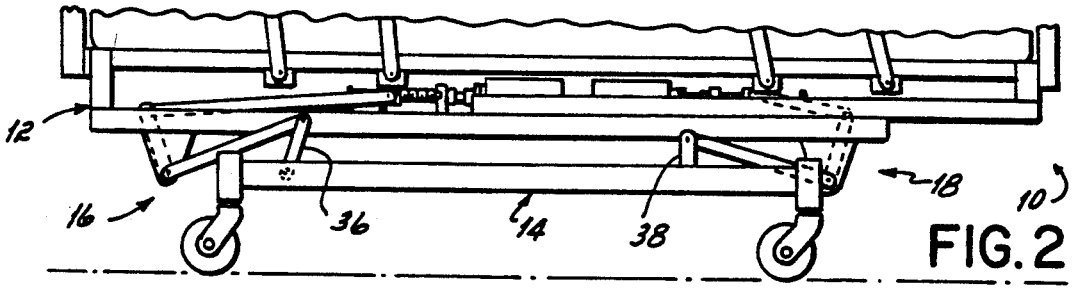
FIG. 2 is a partial side view of the hospital bed in a lowered position.
Figure 3:
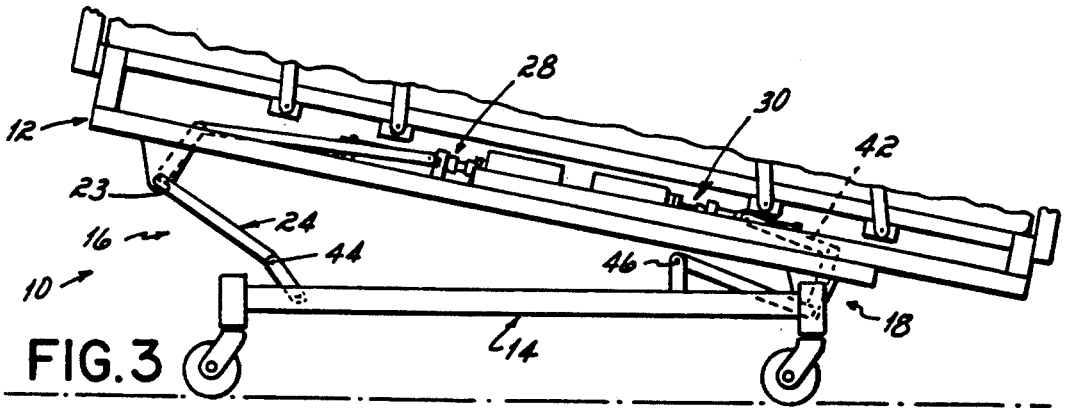
FIG. 3 is a partial side view of the hospital bed in the reverse Trendelenburg position.
Figure 4:
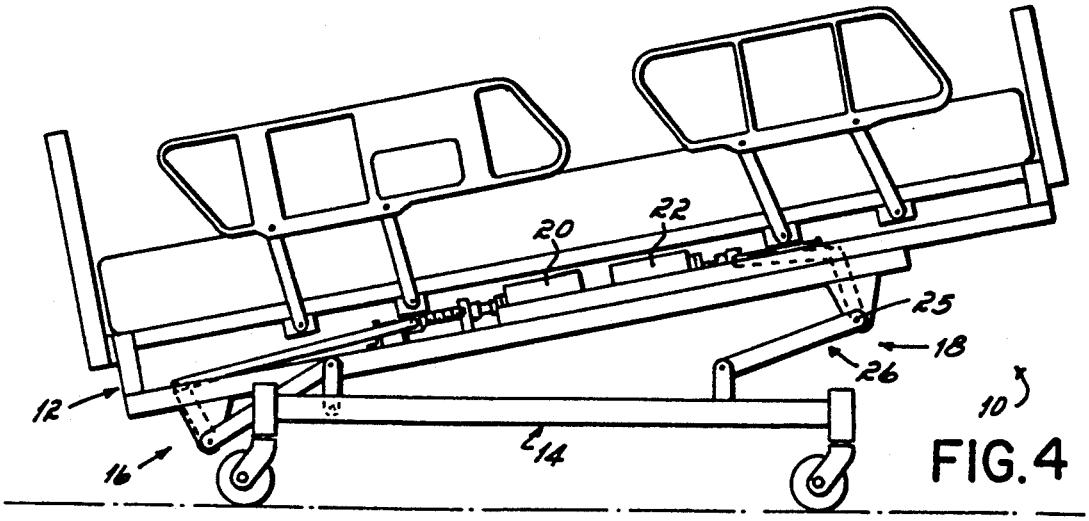
FIG. 4 is a side elevation view of the hospital bed in the Trendelenburg position.

The actuators 20 and 22 may be selectively operated to move the ends of the bed support frame 12 relative to the base 14 in the same vertical direction thereby changing the height of the bed support frame relative to the base. Consequently, the bed support frame typically in a horizontal position may be raised as shown in FIG. 1 or lowered as shown in FIG. 2. Further, if the bed support frame is at an inclined position, operating the actuators in unison will raise or lower the bed support frame without substantially changing its inclination. Alternatively, selectively operating the actuators to move one end of the bed support frame vertically relative to its other end will incline the bed support frame, thereby selectively moving the bed support frame to either the reverse Trendelenburg position shown in FIG. 3 or the Trendelenburg position shown in FIG. 4.

Figure 5:
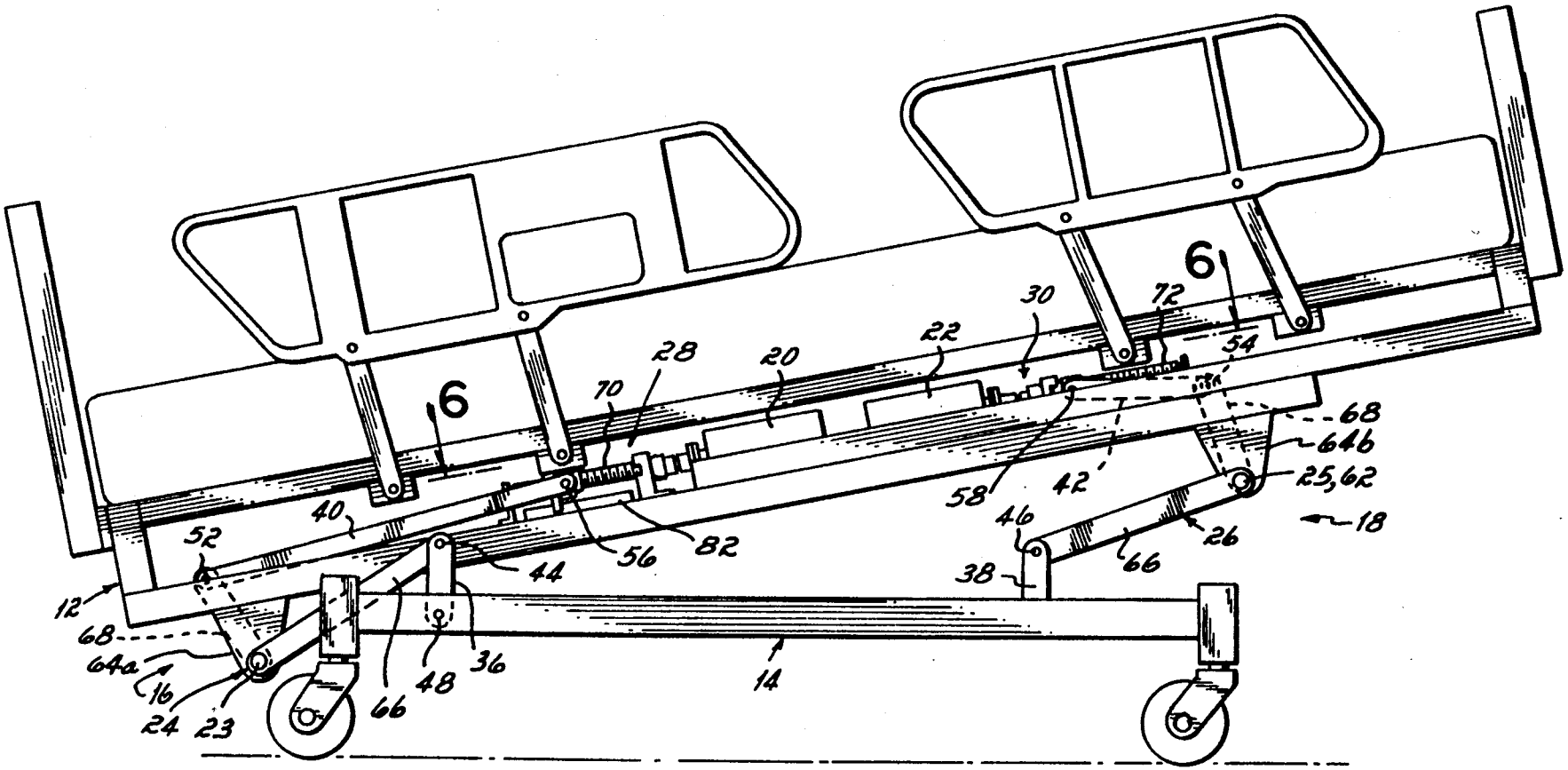
FIG. 5 is a larger side elevation view of the 6—6 of FIG. 5.
Figure 6:
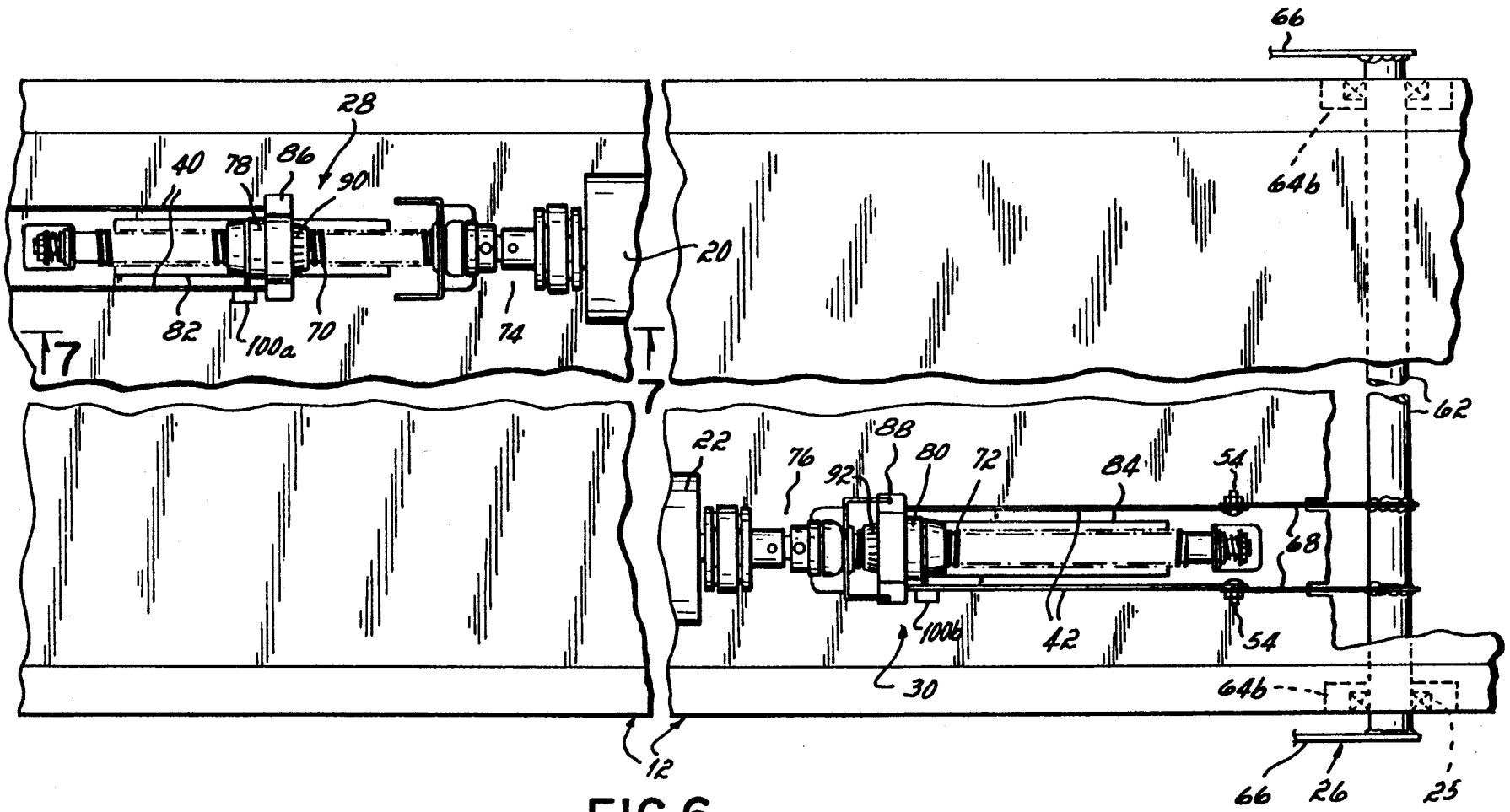
FIG. 6 is a cross-sectional view taken along lines 6—6 of FIG. 5.
Figure 7:
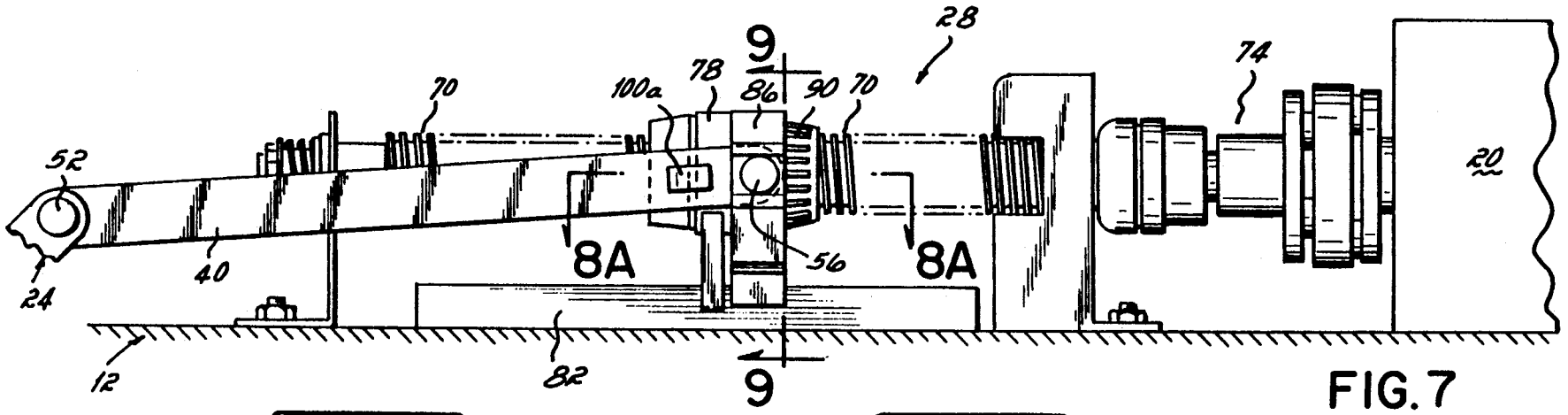
FIG. 7 is a cross-sectional view taken along lines 7—7 of FIG. 6.

Referring to FIG. 5, the mechanical drives 16 and 18 are comprised of lift arm links 24 and 26 and drive mechanisms 28 and 30. The lift arm links 24 and 26 are substantially identical in construction. The lift arm links 24 and 26 are pivotally connected to the base 14 by support links 36 and 38, respectively. The support links are pivotally connected to first ends of the lift arm links 24 and 26 at pivot points 44 and 46, and support links 36 and 38 are pivotally connected to the base at pivot points 48 and 50. The lift arm links 24 and 26 are connected to the drive mechanisms 28 and 30 by drive links 40 and 42, respectively. Drive links 40 and 42 are pivotally connected to second ends of the lift arm links 24 and 26 at pivot points 52 and 54; and drive links 40 and 42 ar pivotally connected to the drive mechanisms 28 and 3 at pivot points 56 and 58. As shown in FIG. 6, each of the links and pivot points shown in FIG. 5 located on one side of the drive mechanism are replicated on an opposite side of the drive mechanism thereby providing a balanced application of forces. Each lift arm link 24, 26 is rigidly connected to a respective torque shaft 62 rotatably mounted through a pair of flanges 64*a*, 64*a* and 64*b*, 64*b*, respectively connected to the bed support frame 12 (FIG. 6). Each lift arm link 24, 26 comprises a pair of first arms 66, 66 rigidly connected to the ends of each shaft 62 at one end and pivotally connected to the pair of pivot links 36, 36 and 38, 38 at their other end. A pair of second arms 68, 68 are rigidly connected to each shaft 62 at one end and are pivotally connected to the pair of drive links 40, 40 and 42, 42 at their other end. The included angle between the first and second arms is approximately 90°.

The drive mechanisms 28 and 30 illustrated in detail in FIGS. 5-9 convert rotary motion of an actuator output shaft and drive screw into translation of a nut threadedly connected to the drive screw. The drive mechanisms 28 and 30 are comprised of drive screws 70 and 72 connected to output shafts 74 and 76 of actuators 20 and 22, respectively. Lift nuts 78 and 80 are rotatably mounted to their respective screws 70 and 72 and, in addition, are slidably mounted on rails 82 and 84, respectively. The rails 82 and 84 are effective to linearly guide the translating lift nuts and prevent deflection of the drive screws by providing a support transverse to the longitudinal axis of the drive screws.

Figure 9:
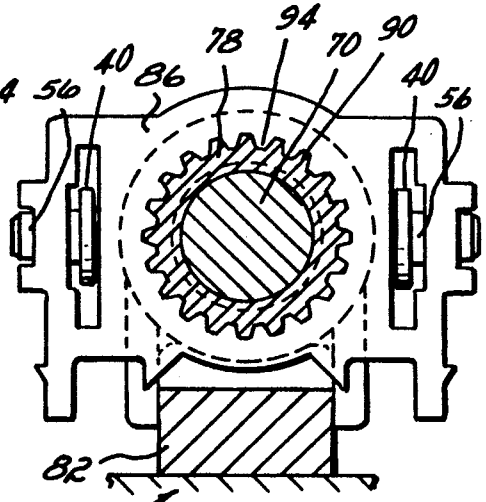
FIG. 9 is a cross-sectional view taken along lines 9—9 of FIG. 7.
Figure 8B:
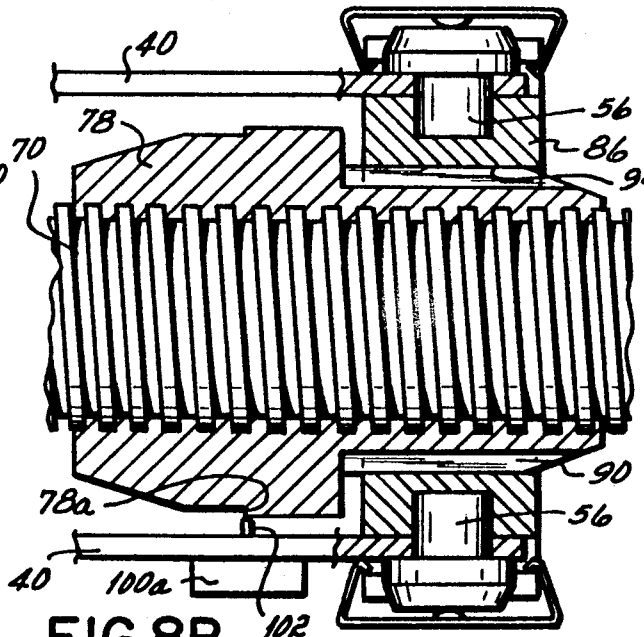
FIG. 8B is a cross-sectional view taken along lines 8A—8A illustrating separation between the lift nut and output block.
Figure 8A:
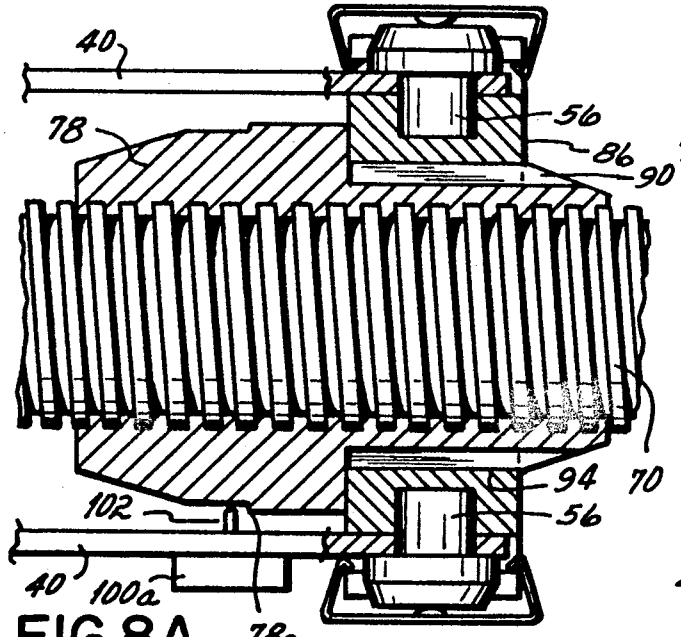
FIG. 8A is a cross-sectional view taken along lines 8A—8A of FIG. 7 illustrating a normal relationship between the lift nut and output block.

Slidably mounted on the nuts 78 and 80 are output blocks 86 and 88 which are connected to the drive links 40, 40 and 42, 42, respectively. The lift nuts 78 and 80 contain splines 90 and 92, respectively, which, as shown in FIG. 9, mesh and engage with corresponding splines inside the output block such as shown at 94. The lift arm links are arranged such that a gravitational force exerted on the bed support frame 12 is effective to bias the output blocks 86 and 88 tightly against the lift nuts 78 and 80. When the bed support frame is being raised, the lift nuts 78 and 80 are moving in a direction so as to push the output blocks 87 and 88 along the drive screws 70 and 72, respectively. When the bed support frame is being lowered, the lift nuts are moving in the opposite direction along the drive screws. The gravitational force of the bed support frame and any patient support thereby, which is applied through the drive links 40, 40 and 42, 42, is effective to hold the output blocks 86 and 88 in contact with the lift nuts 78 and 80, as shown in FIG. 8A. As the bed support frame is moving downward, and if it encounters an obstacle which provides a reactive force in opposition to the gravitational force, the gravitational force is removed from the drive links 40, 40; and the continuing translation of the lift nut 78 results in the lift nut 78 separating from the output block 86 as shown in FIG. 8B. The relative motion of the lift nut to the output block is detected by a limit switch 100 connected to the drive link 40 or other element fixed with regard to the output block. The limit switch has a trigger arm 102 which is activated by shoulder 78*a* of the lift nut 78 in response to its separation from the output block 86. The electrical contacts within the switch 100 are connected in the power circuit to the actuator 20 in a manner well known to those who are skilled in the art. Actuation of the trigger arm 102 opens the electrical contacts within the switch 100 thereby interrupting power to the actuator 20 and terminating its operation, the rotation of the drive screw 70 and the translation of the lift nut 78. Therefore, the motion of the bed support frame in a downward direction is stopped in response to that end of the bed frame encountering the obstacle.

While the invention has been illustrated in some detail according to the preferred embodiments shown in the accompanying drawings, and while the preferred embodiments have been described in some detail, there is no intention to thus limit the invention to such detail. On the contrary, it is intended to cover all modifications, alterations and equivalents following within the spirit and scope of the appended claims.

What is claimed is:

1. A hospital bed adjustable in height and selectively movable to Trendelenburg and reverse Trendelenburg positions at any height comprising:

a base having first and second ends;

a bed support frame having first and second ends;

first and second actuators; and first and second mechanical drives connected between said first and second ends of said base and said bed support frame, respectively, each of said mechanical drives being connected to one of said actuators whereby selectively operating said actuators to move said ends of said bed support frame in the same direction changes the height of said bed support frame relative to said base, and selectively operating said actuators to move said first and second ends of said bed support frame vertically relative to one another moves said bed support frame to the Trendelenburg and reverse Trendelenburg positions;

each of said first and second mechanical drives comprising a lift arm link having first and second ends, said first end being pivotally connected to one end of said base and said second end being operably pivotally connected to a drive mechanism, said lift arm link being pivotally connected intermediate its ends to said bed support frame;

said drive mechanism having a drive screw connected to ne of said actuators and having an output block operably connected to said drive screw and said second end of said lift arm link whereby said output block translates in response to said actuator rotating said drive screw;

each of said drive mechanisms further comprising:

a lift nut mateably threaded with said drive screw, said lift nut being operable to translate along said drive screw in response to rotation of said drive screw; and said output block is slidably mounted on said lift nut whereby operation of said actuator in first and second rotational directions translates both said lift nut and output block in respective first and second directions thereby lowering and raising one end of said bed support frame respectively.

2. The hospital bed of claim 1 wherein said lift nut translates independently of and with respect to said output block in response to lowering said bed support onto an obstacle.

3. The hospital bed of claim 2 wherein said drive mechanism further comprises means responsive to motion of said lift nut relative to said output block for interrupting operation of said actuator.

4. The hospital bed of claim 3 wherein said actuator is an electric motor and said means for interrupting operation of said actuator is an electric switch.

5. The hospital bed of claim 1 wherein said first end of said lift arm link is pivotally connected to a first end of a pivot link, said pivot link having a second end pivotally connected to said base.

6. The hospital bed of claim 1 wherein said second end of said lift arm link is pivotally connected to a first end of a driver link, said driver link having a second end pivotally connected to said output block.

7. The hospital bed of claim 1 wherein said actuators are mounted on said bed support frame.

8. A mechanical drive adapted to be connected to an actuator for moving a load on a bed support frame relative to a base, said load exerting a gravitational force on said mechanical drive, said mechanical drive comprising:

a drive screw adapted to be connected to the actuator;

a lift nut rotatably mounted to said drive screw, said lift nut being operable to translate along said drive screw in response to rotation of said drive screw;

an output block slidably mounted on said lift nut whereby operation of the actuator in first and second rotational directions translates both said lift nut and output block in respective first and second directions thereby moving the load in correspondingly different directions; and, a linkage having one end pivotally connected to said output block and another end pivotally connected to said base, said linkage pivotally connected to the load at a point intermediate its ends and being operable to apply the gravitational force of the load to said output block to bias said output block against said lift nut.

9. The mechanical drive of claim 8 wherein said lift nut includes a shoulder means against which said output block abuts when said linkage applies the gravitational force of the load to said output block.

10. The mechanical drive of claim 9 wherein said shoulder means on said lift nut transfers force to and from said output block for raising and lowering the load but does not transfer force from said block when an obstacle obstructs lowering of the load.

11. The mechanical drive of claim 8 further including a switch means mounted for detecting relative translation between said lift nut and said output block and being operable to interrupt actuator operation when an obstacle obstructs lowering of the load.

12. A hospital bed comprising:

a base having first and second ends;

a bed support frame having first and second ends;

first and second actuators mounted on said bed support frame; and first and second mechanical drives, each of said mechanical drives operatively connected between one of said actuators and said base and including:

a drive screw connected to one of said actuators, a lift nut rotatably mounted on said drive screw, said lift nut translating along said drive screw in response to rotation of said drive screw, an output block slidably mounted on said lift nut whereby rotation of said actuator in first and second directions translates both said lift nut and said output block in respective first and second directions thereby generally raising and lowering one end of said bed support frame, a linkage having one end pivotally connected to said output block and another end pivotally connected to said base, and a switch connected to said drive mechanism for detecting a relative motion between said lift nut and said output block in response to an obstacle obstructing said one end of said bed support frame from lowering, said switch being operable upon activation of said switch to interrupt operation of an actuator lowering said one end of said bed support frame.

* * * * *

UNITED STATES PATENT AND TRADEMARK OFFICE

CERTIFICATE OF CORRECTION

PATENT NO. : 5,317,769

DATED : June 7, 1994

INVENTOR(S) : Weismiller et al.

It is certified that error appears in the above-identified patent and that said Letters Patent is hereby corrected as shown below:

Column 2, line 25, "6-6 of Fig. 5" should be -- hospital bed in the Trendelburg position --.

Column 3, line 15, "ar" should be -- are --.

Column 3, line 16, "3" should be -- 38 --.

Column 4, line 56, claim 1, "ne" should be -- one --.

Signed and Sealed this

Eighth Day of November, 1994

Bruce Lehman

*Attest:*

BRUCE LEHMAN

*Attesting Officer*

*Commissioner of Patents and Trademarks*